US011424588B2

(12) United States Patent
Da Anunciação et al.

(10) Patent No.: US 11,424,588 B2
(45) Date of Patent: Aug. 23, 2022

(54) WIRE CUTTER APPARATUS FOR CUTTING A WIRE AND CRIMPING ITS ENDS

(71) Applicant: APTIV TECHNOLOGIES LIMITED, St. Michael (BB)

(72) Inventors: Filipe Fernandes Da Anunciação, Corroios (PT); António José Costa Da Silva, Agualva (PT)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 120 days.

(21) Appl. No.: 16/640,800

(22) PCT Filed: Aug. 16, 2018

(86) PCT No.: PCT/EP2018/072198
§ 371 (c)(1),
(2) Date: Feb. 21, 2020

(87) PCT Pub. No.: WO2019/038171
PCT Pub. Date: Feb. 28, 2019

(65) Prior Publication Data

US 2021/0006025 A1 Jan. 7, 2021

(30) Foreign Application Priority Data

Aug. 21, 2017 (EP) ..... 17187008

(51) Int. Cl.
*H01R 43/052* (2006.01)

(52) U.S. Cl.
CPC ..... *H01R 43/052* (2013.01)

(58) Field of Classification Search
CPC ..... H01R 43/05; H01R 43/052; H01R 43/28
See application file for complete search history.

(56) References Cited

U.S. PATENT DOCUMENTS 4,183,383 A 1/1980 Gudmestad et al.
4,554,725 A 11/1985 Over et al.
(Continued)

FOREIGN PATENT DOCUMENTS

CN 1921030 A 2/2007
CN 202997278 U 6/2013
WO 97/32370 9/1997

OTHER PUBLICATIONS

First Notification of Office Action for CN Application No. 201880054499.0 dated Oct. 10, 2020.
(Continued)

*Primary Examiner* — Minh N Trinh
(74) *Attorney, Agent, or Firm* — Carlson, Gaskey & Olds, P.C.

(57) ABSTRACT

A wire cutter apparatus includes a first rotatable wire guiding tube for receiving the leading end of a wire. The first tube has a wire entrance and a wire exit and is rotatable around the wire entrance whereby the wire exit is movable between a first wire exit position coinciding with a longitudinal feeding axis and a second wire exit position spaced away from the longitudinal feeding axis. The apparatus includes a similar, second rotatable wire guiding tube. A first crimping press receives the leading end of the wire when the wire exit is in the second wire exit position. The first crimping press and the second crimping press are both at least partially located between the longitudinal feeding axis and a first side wall.

12 Claims, 7 Drawing Sheets

(56) References Cited

U.S. PATENT DOCUMENTS

| | | | | |
|---|---|---|---|---|
| 4,596,174 | A * | 6/1986 | LaFleur | B65H 51/18 226/112 |
| 4,682,391 | A | 7/1987 | Hall, Jr. et al. | |
| 5,025,549 | A | 6/1991 | Horung et al. | |
| 5,842,266 | A * | 12/1998 | Ishiwata | H01R 43/28 29/33 M |
| 6,212,757 | B1 * | 4/2001 | Hasegawa | H01R 43/05 29/33 M |
| 7,603,768 | B2 * | 10/2009 | Viviroli | H01R 43/0488 29/33 M |
| 8,973,802 | B2 * | 3/2015 | Fischer | B65H 51/14 226/24 |
| 2021/0006025 | A1 * | 1/2021 | Daanunciao | H01R 43/052 |

OTHER PUBLICATIONS

International Search Report for International application No. PCT/EP2018/072198 dated Jul. 11, 2018.

* cited by examiner

WIRE CUTTER APPARATUS FOR CUTTING A WIRE AND CRIMPING ITS ENDS

TECHNICAL FIELD

The invention relates to a wire cutter apparatus for cutting wires and a wire cutter assembly comprising more than one wire cutter apparatuses. Typically, wires comprise an internal conductive core surrounded by an outer insulation layer. The ends of the wire are typically crimped to a conductive terminal. Wire cutter apparatuses cut the wire to a desired length and crimp terminals to each end of the wire. The technical field of the invention is therefore wire cutting and crimping apparatuses in particular for automotive industry.

BACKGROUND OF THE INVENTION

Wire cutter apparatuses are widely known to continuously cut a single wire into multiple smaller wires and provide the ends of the wires with conductive terminals. The terminals are typically crimped to a conductive core of the wire and may also be crimped with an insulation crimp to an outer insulation of the wire.

These wires may be used for electric applications in which power or data is transferred from one end of the wire, e.g. a leading end, to a second end of the wire, e.g. a rear end. Typically, after the wires are being cut in smaller wires the leading end and the rear end are provided with terminals and/or connectors. After the wire is provided with terminals and/or connectors the wire can be connect to a counter terminal and/or counter connector.

For example, in automotive industry such wires are used in electric and electronic architecture systems such as wire harnesses or digital data cables such as high speed Ethernet cables. In today's competitive markets, such as the automotive market, there is a desire to reduce the cost and produce and cut wires as efficient as possible.

A wire cutter apparatus according to the state of art comprises a first crimping press and a second crimping press to respectively crimp a leading end and a rear end of a wire. Typically, the wire is cut first at a location on the wire that corresponds with the required length. By cutting the wire, the rear end of the wire is defined and a leading end of a new wire is formed. Said rear end is typically crimped by the second crimping press and a wire having two crimped ends is created.

Looking in a feeding direction of the wire into the wire cutter apparatus, typically the first crimping press is arranged before the second crimping press in order to firstly crimp the leading end of the wire and subsequently the rear end of the wire.

The first crimping press is located spaced away from a longitudinal axis that is in line with a feeding axis of the wire. In order to bring the leading end to the first crimping press, movable wire guiding tubes are used.

The same holds for the second crimping press that is also spaced away from the feeding axis in a direction opposite to the first crimping press. Again, another movable wire guiding tube is used to bring the rear end of the wire to the second crimping press.

A drawback of such a wire cutter apparatus is that it takes time to service the crimping presses. For example, the crimping presses need to be replaced by another punch or the crimping presses need to be verified if they are still in working order.

Typically, one operator would service one wire cutter apparatus and would need to walk to the first crimping press and subsequently all the way around the wire cutter apparatus to the other side to service or supervise the second crimping press.

Another drawback is that when the wire cutter apparatus is in operation it is often difficult to supervise both crimping presses at the same time and the operator needs to walk from one side to the other side.

Example embodiments of the invention provide a wire cutter apparatus and/or an assembly of wire cutter apparatuses that can be operated more efficiently.

SUMMARY OF THE INVENTION

An illustrative example embodiment of a wire cutter apparatus is for cutting a wire and crimping a leading end and subsequently a rear end of the wire. The wire cutter apparatus comprises an interior space defined by side walls. The side walls at least comprise a first side wall and a second sidewall both extending parallel to a longitudinal feeding axis. The second side wall opposes the first side wall.

The wire cutter further comprises a wire feeding opening provided in a third side wall for feeding the wire from an exterior space into the interior space. The interior space is at least between the first side wall and the second side wall. The feeding direction defines the longitudinal feeding axis.

The wire cutter further comprises a first rotatable wire guiding tube for receiving the leading end of the wire. The tube is hollow to receive firstly the leading end of the wire such that the wire can be guided inside and through the tube.

The first tube therefore has a wire entrance and a wire exit. The first rube is rotatable around the wire entrance whereby the wire exit is movable from a first wire exit position coinciding with the longitudinal feeding axis to a second wire exit position spaced away from the longitudinal feeding axis and vice-versa.

The wire cutter apparatus also comprises a first crimping press for receiving the leading wire end of the wire when the wire exit is in the second wire exit position. As the leading end of the wire is brought to the first press by rotating the first tube, the leading end of the wire can be crimped by the first crimping press. The first crimping press is spaced away from the longitudinal feeding axis and configured to crimp the leading wire end.

The wire cutter apparatus comprises a second rotatable wire guiding tube for receiving the leading end of the wire. The second tube is hollow to receive firstly the leading end of the wire such that the wire can be guided inside and through the tube.

The second tube has therefore a wire entrance and a wire exit and is rotatable around its wire exit. Its wire entrance is movable from a first wire entrance position coinciding with the longitudinal feeding axis (X) to a second wire entrance position spaced away from the longitudinal feeding axis (X) and vice-versa.

The wire cutter apparatus further comprises a second crimping press. The second crimping press is suitable for receiving the rear wire end from the wire when the wire entrance of the second tube is in the second wire entrance position. Typically, when the leading end of the wire has been crimped, the wire is transferred further along the longitudinal feeding axis and subsequently cut by a wire cutter.

For this purpose, the wire cutter apparatus also comprises a wire cutter configured to cut the wire between the wire exit from the first rotatable wire guiding tube and the wire entrance from the second rotatable wire guiding tube when the wire exit and the wire entrance are respectively in the first wire exit position and the first wire entrance position.

As the rear end of the wire is brought to the second press by rotating the second tube, the rear end of the wire can be crimped by the second crimping press. The second crimping press being spaced away from the longitudinal feeding axis and configured to crimp the rear wire end.

In an example embodiment, the first crimping press and the second crimping press are both at least partially located between the longitudinal feeding axis and the first side wall.

Having the first crimping press and the second crimping press located at a same side facing at least partly the same first side wall allows an operator to continuous monitor the crimping presses at the same time without having to walk from the first side wall to the opposing second side wall.

In an example embodiment, when the wire cutter apparatus machine must be serviced, the first crimping press and the second crimping press are at the same side allowing the operator to walk a smaller distance between the first crimping press and the second crimping press.

Because both the first and the second crimping presses are facing the same side wall, they can be made shorter and serviced from one same side. This allows increasing the speed of servicing both crimping presses.

Moreover, compared to prior art wire cutter apparatuses, the width of the wire cutter apparatus according to example embodiments of the invention may be smaller and may be even halved. This allows a wire cutter apparatus to take less space and makes it more compact and easier for the operator to operate and service.

Another illustrative example embodiment of a wire cutter apparatus assembly comprises a first wire cutter apparatus as described above and a second wire cutter apparatus. The wire cutter assembly further comprises an operator space disposed between the first wire cutter apparatus and the second wire cutter apparatus. For example, the operator space is suitable for the operator to operate the first wire cutter assembly as well as the second wire cutter assembly. For example, a first human machine interface suitable to control and monitor the first wire cutter apparatus is facing the operator space. A second human machine interface suitable to control and monitor the second wire cutter apparatus may face the operator space as well. Preferably, the first and the second wire cutter apparatuses may be controlled and monitored by only one human machine interface either being the first or the second.

In an example embodiment, the first and second crimping presses of the first wire cutter apparatus and the first and second crimping presses of the second wire cutter apparatus all face the operator space.

Having all crimping presses facing the operator space allows one operator to supervise and service two wire cutter apparatuses at the same time with a minimum of distance between the crimping presses.

In other words, the first wire cutter apparatus and the second wire cutter apparatus are mirrored. Having the first and second crimping press of a wire cutter apparatus both facing a same side wall allows this mirroring.

Moreover, compared to prior art wire cutter apparatuses, the width of the wire cutter apparatus may be smaller and may be even halved. This allows a wire cutter apparatus to take less space and makes it more compact and easier for the operator to operate and service.

Also it allows for no, or at least less, walking to service or load the presses.

The assembly may also reduce cutter costs as a same machine frame or chassis may be shared as well as sharing a control unit, such like a computer and a human machine interface.

It also allows for less walking for the operator for setting up the wire cutter apparatuses and may also reduce the set-up time for material transporters. It therefore also allows for more output per cutter due to shorter set-up times.

The number of operators and maintenance costs may be reduced. It also allows for a reduced consummation of power making the wire cutter apparatus more energy efficient.

Peripheral equipment may be shared. For example, instead of multiple, only one of the following peripheral equipment may be used: measuring ruler, pull out force device, magnifying glass, height measuring device, USB microscope camera, Label printer, etc.

Preferably, the first rotatable wire guiding tube is configured to move its wire exit outwards from the longitudinal feeding axis towards the first side wall. Furthermore, the second rotatable wire guiding tube is configured to move its wire entrance outwards from the longitudinal feeding axis towards the first side wall.

This allows both the crimping presses being arranged at the same first side wall reducing the distance between both crimping presses and improving the ability for the operator to supervise and service the crimping presses.

In an embodiment of the wire cutter apparatus according to the invention, the length of one of the first and second rotatable wire guiding tube is longer than the length of the other first and second rotatable wire guiding tube.

One of the respective first and second crimping presses is spaced away further from the longitudinal feeding axis than the other of the first and second crimping presses.

For example, the length of the first rotatable wire guiding tube is greater than the length of the second rotatable wire guiding tube. In this example, the first crimping press is spaced away further from the longitudinal feeding axis than the second crimping press.

As the lengths differ, the lateral distance between the longitudinal feeding axis and respectively the second wire exit position and the second entrance position differ as well.

This allows the first crimping press and the second crimping press to be spaced away at different lateral distances from the longitudinal feeding axis.

This may have as advantage that the wire cutter apparatus is more compact while it still provides the supervision and servicing advantages for an operator.

In an embodiment of the wire cutter apparatus according to the invention, at least one of the first and second rotatable wire guiding tubes comprises a kink.

Preferably, the kink is defined in a horizontal plane. The horizontal plane is spanned by the longitudinal feeding axis and a lateral axis pointing to the first crimping press and perpendicular to the longitudinal feeding axis. In other words, the lateral axis coincides or at least is parallel with a smallest distance between the longitudinal feeding axis and the first crimping press. Preferably, the second crimping press lies in the same horizontal plane.

This allows the first crimping press and the second crimping press being closer together in the longitudinal direction. By further reducing the distance between the first crimping press and the second crimping press an operator may more easily supervise and/or service the crimping presses.

It further allows for increasing the speed of rotation of the rotatable wire guiding tube, allowing the wire cutter apparatus to operate faster.

In an embodiment of the wire cutter apparatus according to the invention, at least one of the first and second cutting presses is at least partially arranged in the exterior space traversing the first side wall through an opening.

This has as advantage that it allows the operator to more easily service the crimping press as it is already at least partly outside of the wire cutter apparatus.

In an embodiment of the wire cutter apparatus according to the invention, the first and the second rotatable wire guiding tubes rotate in a horizontal plane and wherein the side walls are arranged in a vertical plane.

The horizontal plane is spanned by the longitudinal feeding axis and a lateral axis pointing to the first crimping press and perpendicular to the longitudinal feeding axis. In other words, the lateral axis coincides or at least is parallel with a line representing the smallest distance between the longitudinal feeding axis and the first crimping press. A vertical axis is orthogonal with respect to the longitudinal feeding axis and the transverse axis.

The side walls are arranged all parallel to this vertical axis. In other words, the vertical plane may be any plane that is parallel to said vertical axis.

For instance, the first side wall is vertically oriented and opposes the second side wall. Perpendicular to both the first and the second side wall a third side wall is arranged. The third side wall is also oriented vertically and this third side wall lies therefore in a vertical plane. The third side wall connects the first and the second side wall.

In an embodiment of the wire cutter apparatus according to the invention, the wire cutter apparatus further comprises a wire feeder for feeding and transporting the wire into and through the first wire guiding tube.

Preferably, the wire cutter apparatus comprises a third side wall disposed between the first and the second side wall in which a wire opening is provided. The wire feeder may preferably be arranged outside the interior space and feeds or pushes the wire towards the first wire guiding tube through the wire opening.

In an embodiment of the wire cutter apparatus according to the invention, the wire cutter apparatus further comprises a wire exit opening provided in one of the side walls for dispensing a cut wire to the exterior space.

Preferably, the wire cutter apparatus comprises a fourth side wall disposed in between the first and the second side wall in which said wire exit opening is provided. The fourth side wall is preferably arranged opposite to the third side wall.

In an embodiment of the wire cutter apparatus according to the invention, the wire cutter apparatus further comprises a wire puller for pulling and transporting a cut wire through the second wire guiding tube and into the exterior space.

Preferably, the wire cutter is arranged in the exterior space and transports or pulls the cut wire through the wire exit opening.

In an embodiment of the wire cutter apparatus according to the invention, the wire cutter apparatus further comprises a wire divider for continuously dividing the wire into a first wire and a second wire. The wire divide is configured to feed a first wire to the first rotatable wire guiding tube and a second wire to a third rotatable wire guiding tube.

In other words, a single wire is divided into two wires. Each wire, the first wire and the second wire, is subsequently cut and crimped by a wire cutter and crimping presses according to the invention. For this purpose the wire cutter machine comprises a first and a second crimping press for the first wire and a third and a fourth crimping press for the second wire. Analogously, the third and the fourth crimping press cooperate respectively with said third rotatable wire guiding tube and a fourth rotatable wire guiding tubes. The third and fourth rotatable wire guiding tubes are similar to the first and the second rotatable wire guiding tubes.

Thus, the wire cutter apparatus further comprises the third rotatable wire guiding tube for receiving the leading end of the second wire. Said third tube comprises a wire entrance and a wire exit and is rotatable around the wire entrance whereby the wire exit is movable from a first wire exit position coinciding with the longitudinal feeding axis to a second wire exit position spaced away from the longitudinal feeding axis and vice-versa.

The wire cutter apparatus comprises a third crimping press for receiving the leading wire end of the second wire when the wire exit of the third rotatable wire guiding tube is in the second wire exit position.

The third crimping press is spaced away from the longitudinal feeding axis and configured to crimp the leading wire end of the second wire.

The wire cutter apparatus comprises a fourth rotatable wire guiding tube for receiving the leading wire end of the second wire. Said fourth tube comprises a wire entrance and a wire exit and is rotatable around its wire exit whereby its wire entrance is movable from a first wire entrance position coinciding with the longitudinal feeding axis to a second wire entrance position spaced away from the longitudinal feeding axis and vice-versa.

The wire cutter apparatus comprises a second wire cutter configured to cut the second wire between the wire exit from the third rotatable wire guiding tube and the wire entrance from the fourth rotatable wire guiding tube when said wire exit and wire entrance are respectively in the first wire exit position and the first wire entrance position.

The wire cutter apparatus further comprises a fourth crimping press for receiving a rear wire end from the second wire when the wire entrance of the fourth tube is in the second wire entrance position. The fourth press is spaced away from the longitudinal feeding axis and configured to crimp the rear wire end of the second wire.

The third crimping press and the fourth crimping press are both at least partially located between the longitudinal feeding axis and the second side wall.

To have third and fourth rotatable wire guiding tubes and crimping presses allows doubling the productivity. In other words, two wires may be crimped at the same time with one operator.

In a further embodiment of said wire cutter apparatus said wire cutter apparatus comprises a second wire exit opening provided in one of the side walls for dispensing a cut and crimped second wire to the exterior space.

A wire cutter assembly may include three wire cutter apparatuses. The first wire cutter apparatus comprises said first, second, third and fourth rotatable wire guiding tubes and crimping presses. The second and third wire cutter apparatus each comprises only a first and a second rotatable wire guiding tube and crimping press. This assembly of wire cutter apparatuses has two operator spaces and may therefore be operated by only two operators. In other words, six wire cutting lines may be operated by only two operators.

The first operator spaces is arranged between the first wire cutter apparatus and the second wire cutter apparatus whereby the first and second crimping press of the second wire cutter apparatus as well as the third and fourth crimping press of the first wire cutter apparatus all face the first operator space.

The second operator spaces is arranged between the first wire cutter apparatus and the third wire cutter apparatus whereby the first and second crimping press of the third wire cutter apparatus as well as the first and second crimping press of the first wire cutter apparatus all face said second operator space.

This allows each of the two operators may supervise and/or service four crimping presses as they are all facing the operator.

BRIEF DESCRIPTION OF THE DRAWINGS

The present invention is now described by way of example with reference to the accompanying drawings in which.

DETAILED DESCRIPTION

FIGS. 1*a*, 1*b*, 1*c*, 2*a*, 2*b* and 2*c* disclose a wire cutter apparatus 1 according to a first embodiment wherein each of said figures show the different steps for cutting and crimping a wire 2.

Figures 1A, 1B, 1C:
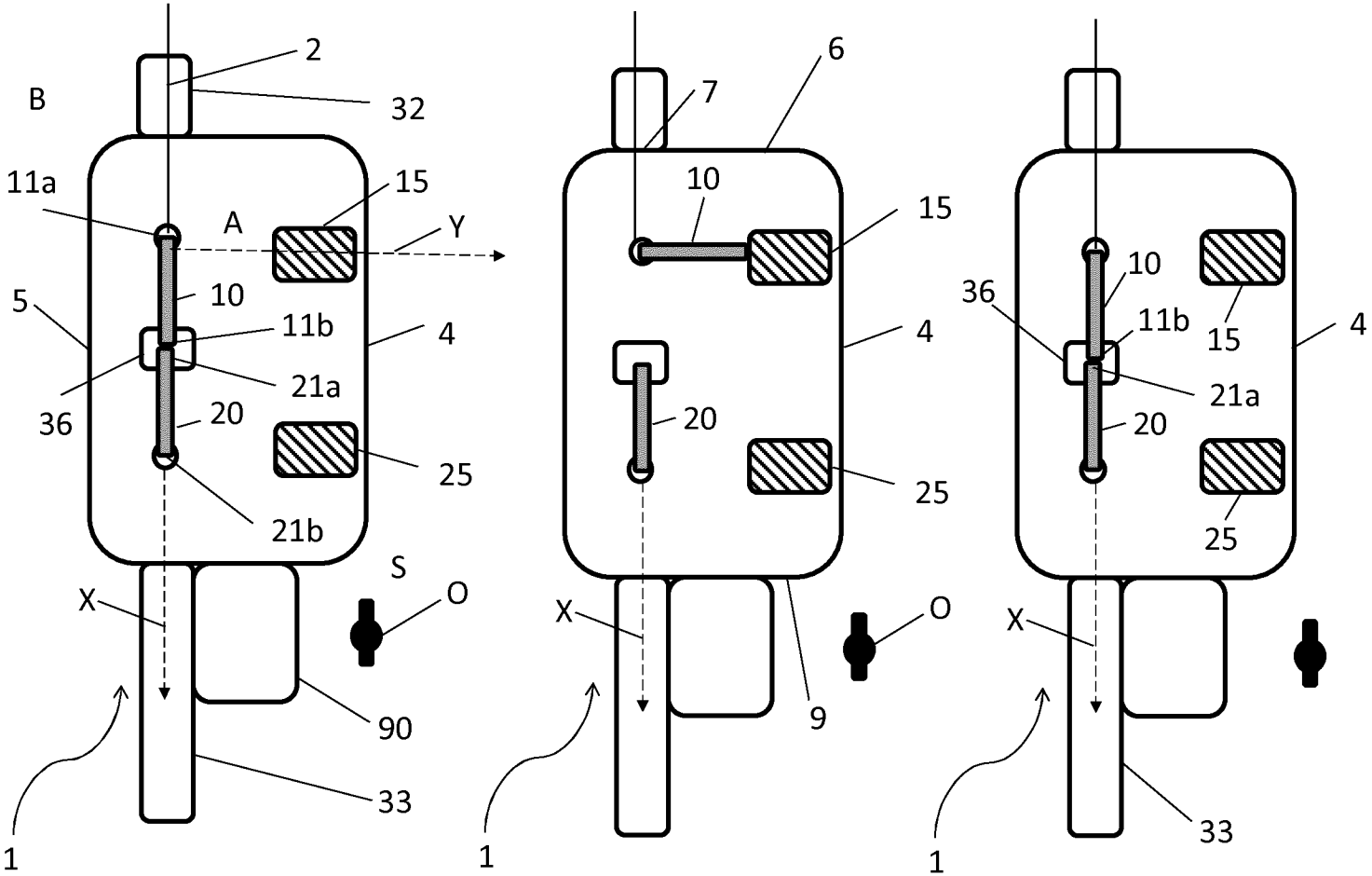
FIGS. 1*a*, 1*b*, 1*c* show a top view of a wire cutter apparatus according to a first embodiment for different positions during the cutting and crimping of a wire.
Figure 2C:
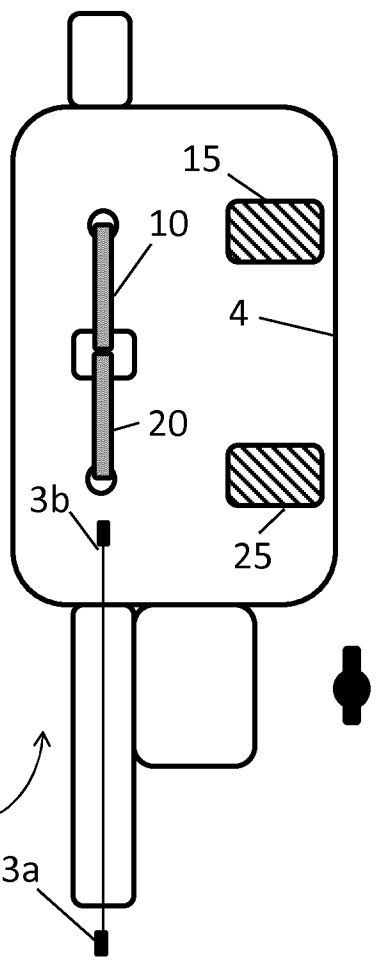
FIGS. 2*a*, 2*b*, 2*c* show a top view of the wire cutter apparatus according to the first embodiment for further different positions during the cutting and crimping of a wire.

FIG. 1*a* shows the wire cutter apparatus 1 just before cutting and crimping a wire 2 and the final result of the wire 2 with a crimped leading end 3*a* and a crimped rear end 3*b* can be seen in FIG. 2*c*.

The wire cutter apparatus 1 comprises a first side wall 4 and an opposing second side wall 5. It furthermore comprises a third side wall 6 in between the first side wall 4 and the second side wall 5. A fourth side wall 9 is disposed in between the first side wall 4 and the second side wall 5 and opposes the third side wall 6. The side walls 4, 5, 6, 9 define an interior space A.

The first side wall 4 and the second side wall extend parallel to a longitudinal feeding axis X.

A wire feeding opening 7, as indicated in FIG. 1*b*, is provided in the third side wall 6 for feeding the wire 2 from an exterior space B into the interior space A. The exterior space is defined as the space lying outside or outwards of the side walls opposed to the interior space A.

A feeding direction of the wire 2 defines the longitudinal feeding axis X. Typically, the wire 2 is inserted or fed along the longitudinal feeding axis and transported along this axis X towards a first rotatable wire guiding tube 10.

The first rotatable wire guiding tube 10 is configured for receiving the leading end 3*a* of the wire 2. For this purpose, the first rotatable wire guiding tube 10 comprises a wire entrance 11*a* at one end of said tube 10.

The first rotatable wire guiding tube 10 is a hollow tube and is able to receive the wire 2 and transport the wire 2 through the tube 10 from one end to the second end, i.e. from the wire entrance 11*a* to a wire exit 11*b*.

The first rotatable wire guiding tube 10 is rotatable around the wire entrance 11*a*. In other words, a pivot point of the first rotatable wire guiding tube 10 is disposed at its wire entrance 11*a*. Preferably, the first rotatable wire guiding tube 10 rotates in a horizontal plane. The horizontal plane is spanned by the longitudinal feeding axis and a lateral axis Y. The lateral axis Y defined by the line of shortest distance between a first crimping press 15 and the longitudinal feeding axis X. Seen from the longitudinal feeding axis X, the lateral axis Y points to the first crimping press 15 and is perpendicular to the longitudinal feeding axis X.

By rotating the first rotatable wire guiding tube 10 the wire exit 11*b* is movable from a first wire exit position coinciding with the longitudinal feeding axis X to a second wire exit position spaced away from the longitudinal feeding axis X and vice-versa. The wire exit 11*b* therefore describes a circular path when being moved.

FIG. 1*a* shows the wire exit 11*b* of the first rotatable wire guiding tube 10 in its first wire exit position. As can be seen, the wire exit 11*b* lies on the longitudinal feeding axis X.

FIG. 1*b* shows the wire exit 11*b* of the first rotatable wire guiding tube 10 in its second wire exit position. As can been, the wire exit 11*b* is spaced away from the longitudinal feeding axis X and is adjacent the first crimping press 15. The first crimping press 15 is suitable for receiving the leading wire end 3*a* of the wire 2 when the wire exit 11*b* is in the second wire exit position as can be seen in FIG. 1*b*. The first crimping press 15 is spaced away from the longitudinal feeding axis X. The first crimping press 15 is configured to crimp the leading wire end 3*a*.

After crimping the leading wire end 3*a*, the first rotatable wire guiding tube 10 is rotated from the second wire exit position to the first wire exit position as shown in FIG. 1*c*.

FIG. 1*c* shows that the wire exit 11*b* is adjacent to a wire entrance 21*b* of a second rotatable wire guiding tube 20. This allows the wire 2 to be guided from the first rotatable wire guiding tube 10 into the second rotatable wire guiding tube 10. In other words, the first rotatable wire guiding tube 10 is aligned with the second rotatable wire guiding tube 20 and forms a continuous tube for transporting the wire 2 from the first tube 10 into the second tube 20.

Like the first rotatable wire guiding tube 10, the second rotatable wire guiding tube 20 is preferably a hollow tube suitable for receiving the leading wire end 3*a* of the wire 2.

Said second tube 20 therefore comprises said wire entrance 21*a* on one end and a wire exit 21*b* on the other end.

The second rotatable wire guiding tube 20 is rotatable, preferably in the horizontal plane, around its wire exit 21*b* whereby its wire entrance 21*a* is movable from a first wire entrance position coinciding with the longitudinal feeding axis X to a second wire entrance position spaced away from the longitudinal feeding axis X and vice-versa.

Before the second rotatable wire guiding tube 20 is rotated from the first wire entrance position to the second wire entrance position, the leading end 3*a* of the wire 2 is guided through the second tube 20 up to the desired rear end 3*b* is located at the wire entrance 21*a* of the second tube 20. This can be seen in FIG. 2*a*, where the leading end 3*a* is now crimped and has exited the wire exit 21*b* of the second tube 20.

As the wire 2 is a continuous wire 2, the wire 2 needs to be cut such that the rear end 3*b* of the wire 2 (being a first wire) is defined and at the same time a leading end of a subsequent second wire is defined.

For this purpose, a wire cutter 36 is configured to cut the wire 2 between the wire exit 11*b* from the first rotatable wire guiding tube 10 and the wire entrance 21*a* from the second rotatable wire guiding tube 20 when said wire exit 11*b* and wire entrance 21*a* are respectively in the first wire exit position and the first wire entrance position. In other words, the wire cutter 36 is placed adjacent the wire exit 11*b* of the first tube 10 and the wire entrance 21*a* of the second tube 20 in the position where the first tube 10 and the second tube 20 form the continuous tube, as can be seen in FIG. 2*a*. The wire 2 is cut by the wire cutter 36 in a cut wire 22.

Now that the rear end 3*b* of the cut wire 22 coincides with the wire entrance 21*a* of the second tube 20, the rear end 3*b* of the cut wire 22 can be moved to a second crimping press 25 by rotating the second tube 20.

Figure 2B:
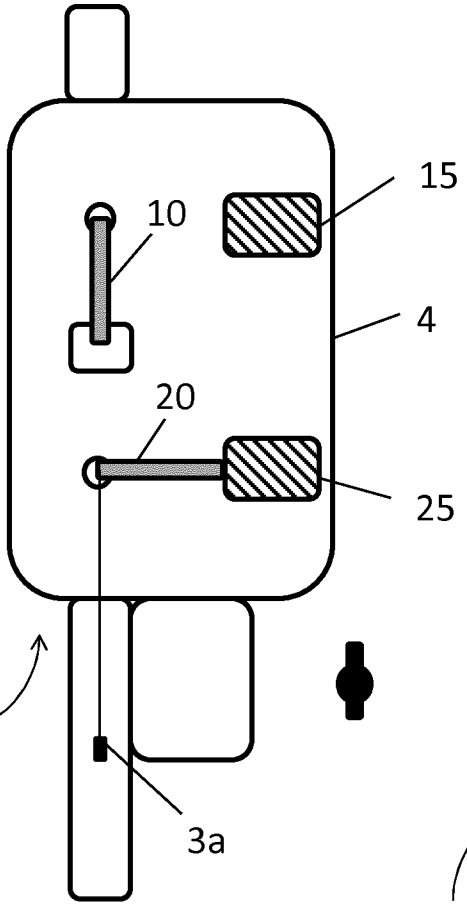
Figure 2A:
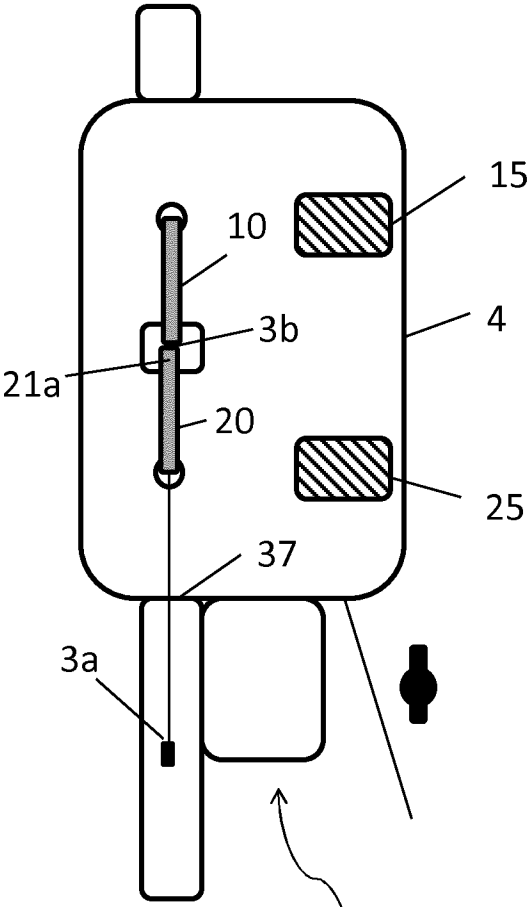

FIG. 2*b* discloses the second wire entrance position wherein the wire entrance 21*a* of the second tube 20 is adjacent the second crimping press 25. Now, the rear end 3*b* of the cut wire 22 is ready to be crimped.

The second crimping press 25 is therefore suitable for receiving the rear wire end 3*b* from the cut wire 2 when the wire entrance 21*a* of the second tube 20 is in the second wire entrance position. The second crimping press 25 is spaced away from the longitudinal feeding axis X and configured to crimp the rear wire end 3*b*.

After crimping the rear wire end 3*b*, the cut wire 22 is transported out of the second tube 20 and out of the interior space A of the wire cutting apparatus 1 as can be seen in FIG. 2*c*.

FIG. 2*c* discloses the cut wire 22 being cut and crimped and ready to be used in a subsequent process, e.g. for forming a wire harness in an automotive application.

Very advantageous is that during the whole process, the first crimping press 15 and the second crimping press 25 are both located between the longitudinal feeding axis X and the first side wall 4.

This allows an operator O to service the first crimping press 15 and second crimping press 25 in a reduced service time as said crimping presses 15, 25 are adjacent the same first side wall 4. For the operator O it is not necessary anymore to walk from the first side wall 4 to the opposite second side wall 5 to service one of the crimping presses 15, 25.

A further advantage is provided during supervising or monitoring the wire cutter apparatus 1 when it is in operation. Having both crimping presses 15, 25 facing a same side allow the operator O to see both crimping presses without having to move.

As can be seen particularly in FIGS. 1*b* and 2*b*, the first rotatable wire guiding tube 10 is configured to move its wire exit 11*b* outwards from the longitudinal feeding axis X towards the first side wall 4 and the second rotatable wire guiding tube 20 is configured to move its wire entrance 21*a* outwards from the longitudinal feeding axis X towards the first side wall 4. In other words, the outward movement is away from the longitudinal feeding axis towards respectively the first and second crimping presses 15, 25 and the first side wall 4.

Preferably, if the wire crimping presses 15, 25 are entirely enclosed by the side walls 4, 5, 6, 9, the first side wall 4 comprises transparent areas. This allows an operator 4 to see the wire crimping presses 15, 25 from the exterior area B.

Alternatively, one or more of the wire crimping presses 15, 25 are partly in the interior area A and traverse partly into the exterior area B through a crimping press opening in the first side wall 4. So, at least one of the first and second cutting presses 15, 25 is at least partially arranged in the exterior space B traversing the first side wall 4 through the crimping press opening.

This has as advantage that it is even easier to service or supervise said crimping press 15, 25 by the operator O.

Preferably, as can be seen in FIGS. 1*a*, 1*b*, 1*c*, 2*a*, 2*b* and 2*c* the first and the second rotatable wire guiding tubes 10, 20, 70, 80 rotate in a horizontal plane and wherein the side walls 4, 5, 6, 9 are in a vertical plane.

The horizontal plane spanned by the transverse axis Y and the longitudinal feeding axis X can be seen in the top view of FIGS. 1*a*, 1*b*, 1*c*, 2*a*, 2*b* and 2*c*. A vertical axis Z is orthogonal with respect to the transverse axis Y and the longitudinal feeding axis X. Thus the vertically arranged first, second, third and fourth side walls 4, 5, 6, 9 form a rectangular shape in this top view.

The side walls 4, 5, 6, 9 are all parallel to said vertical axis Z which points perpendicularly out of the top view of FIG. 1*a*.

Furthermore, the wire cutter apparatus 1 comprises a wire exit opening 37 provided in the fourth side wall 9 for dispensing the wire 2 after cutting to the exterior space B.

The wire cutter apparatus 1 further comprises a wire puller 33, arranged at an exterior side of the fourth side wall 9, for pulling and transporting the wire 2 through the second wire guiding tube 20 and into the exterior space B.

Also shown, is that the wire cutter apparatus 1 further comprises a wire feeder 32, arranged at the exterior side of the third side wall 6, for feeding and transporting the wire 2 into and through the first wire guiding tube 10. In order for the wire 2 to enter the interior space A, the third side wall 6 comprises the wire feeding opening 7.

Figure 3A:
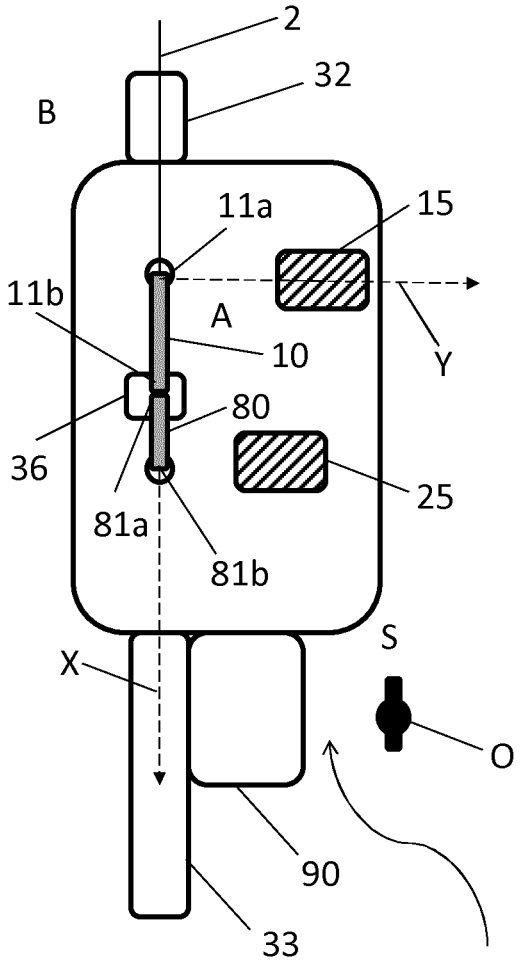
FIGS. 3*a* and 3*b* show a top view of a wire cutter apparatus according to a second embodiment for respectively different positions during the cutting and crimping of a wire.
Figure 3B:
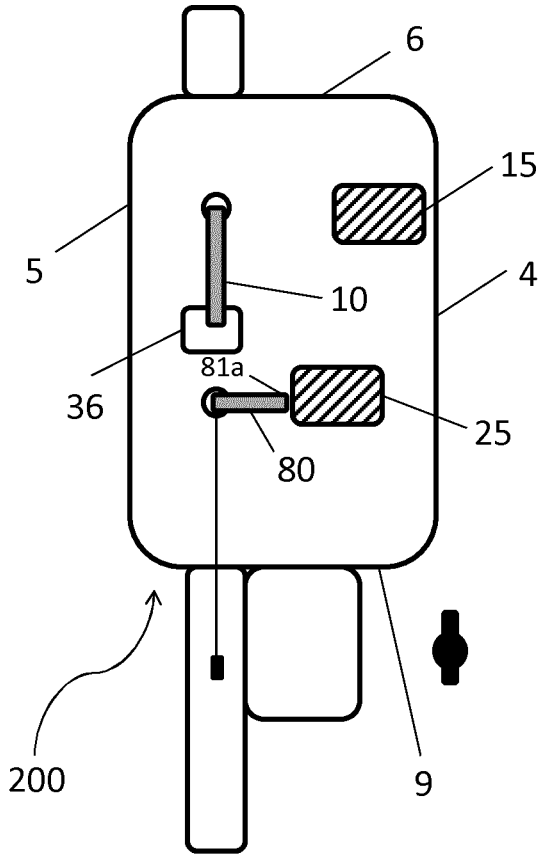

FIGS. 3*a* and 3*b* show a wire cutter apparatus 100 according to a second embodiment. The wire cutter apparatus 100 has similar features as the wire cutter apparatus 1 according to the first embodiment, however the length of the second wire guiding tube 80 is different and by that also the location of the second crimping press 25. All other features may be identical and therefore the same reference numbers used in the second embodiment denote similar features as in the first embodiment.

In other words, the wire cutter apparatus 100 according to the second embodiment comprises a second rotatable wire guiding tube 80 that is shorter than the length of the first rotatable wire guiding tube 10. Or inversely, the first tube 10 is longer than the second tube 80.

Therefore, the first crimping press 15 is spaced away further from the longitudinal feeding axis X than that the second crimping press 25 is spaced away from the longitudinal feeding axis X. Or in other words, the second crimping press 25 is closer to the longitudinal feeding axis X than the first crimping press 15.

Although, the second rotatable wire guiding tube 80 is shorter than the first rotatable wire guiding tube 10, the wire cutter apparatus 200 works similarly as the wire cutter apparatus 200 according to the first embodiment.

To show the difference, FIG. 3*a* shows the wire entrance 81*a* of the second rotatable wire guiding tube 80 in the first wire entrance position and FIG. 3*b* shows the wire entrance

81*a* of the second rotatable wire guiding tube 80 in the second wire entrance position.

As the second crimping press 25 is now arranged closer to the longitudinal feeding axis X than the first crimping press 15 it may now be easier for the operator to simultaneously supervise both crimping presses 15, 25 as the second crimping press 25 does not block the view of the first crimping press 15.

Preferably, the fourth side wall 9 comprises a transparent area allowing the operator to simultaneously supervise the first and second crimping press when he looks in a direction parallel to the longitudinal feeding axis X.

Figure 4B:
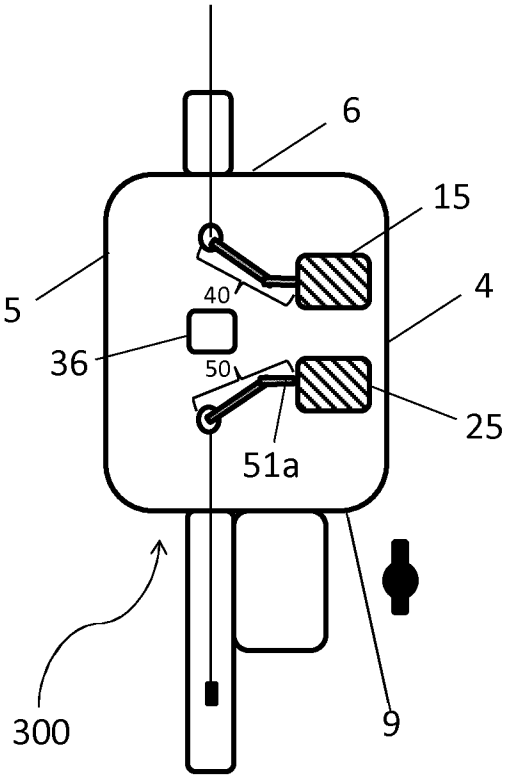
FIGS. 4*a* and 4*b* show a top view of a wire cutter apparatus according to a third embodiment for respectively different positions during the cutting and crimping of a wire.
Figure 4A:
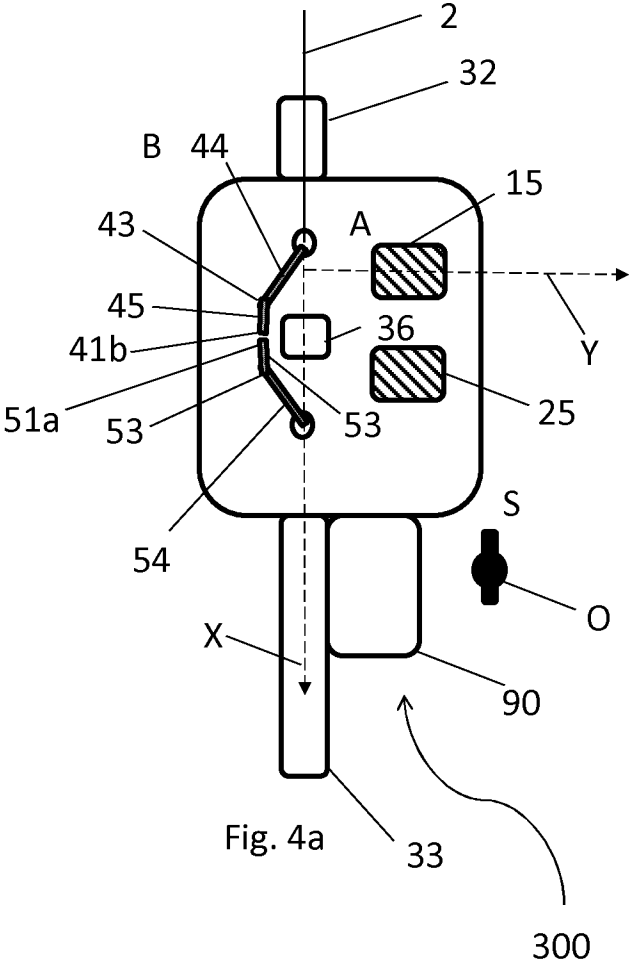

FIGS. 4*a* and 4*b* show a wire cutter apparatus 300 according to a third embodiment of the invention. Again, identical reference numbers denote similar features as in the previous embodiments.

The wire cutter apparatus 300 works similar as the previous embodiments; however both rotatable tubes now comprise a kink or in other words have two rectilinear elements that are angled with respect to each other seen in the horizontal plane.

FIG. 4*a* and FIG. 4*b* show a first rotatable guiding tube 40 comprising a first tube element 44 and a second tube element 45. Both tube elements 44, 45 are hollow to receive the wire 2. The first tube element 44 is angled with respect to the second tube element 45 seen in the horizontal plane. Therefore a kink 43 is formed in the first rotatable wire guiding tube 40.

Also shown is that a second rotatable guiding tube 50 comprises a kink 53 between a first tube element 54 and a second tube element 55.

To show the difference, FIG. 4*a* shows the wire exit 41*b* of the first rotatable guiding tube 40 and the wire entrance 51*a* of the second rotatable guiding tube 50 in respectively the first wire exit position and the first wire entrance position. Or in other words, the wire exit 41*b* and the wire entrance 51 coincide with longitudinal feeding axis.

FIG. 4*b* shows the wire exit 41*b* of the first rotatable guiding tube 40 and the wire entrance 51*a* of the second rotatable guiding tube 50 in respectively the second wire exit position and the second wire entrance position. In other words, the wire exit 41*b* and the wire entrance 51 are near or adjacent respectively the first crimping press 15 and the second crimping press 25.

The advantage of having rotatable wire guiding tubes 40, 50 with a kink 43, 53 is that the first and second crimping press 15, 25 may be arranged closer to each other seen in longitudinal direction.

This has as advantage than operator can more easily service the first crimping press and the second crimping press as they are closer to each other.

Alternatively, not shown in the figures, the first crimping presses 15 may be arranged further away from the second crimping press 25 seen in the longitudinal direction when the kinks in tubes 40, 50 are inversed.

Figure 5B:
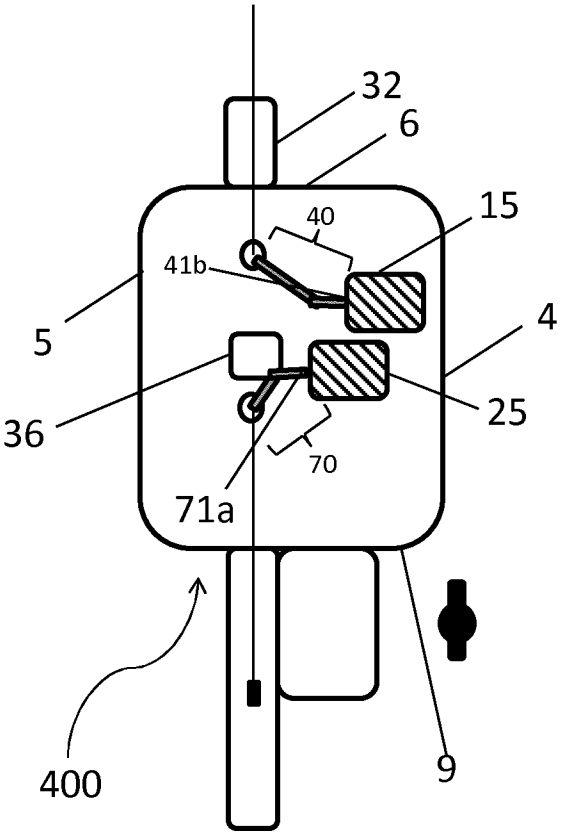
FIGS. 5*a* and 5*b* show a top view of a wire cutter apparatus according to a fourth embodiment for respectively different positions during the cutting and crimping of a wire.
Figure 5A:
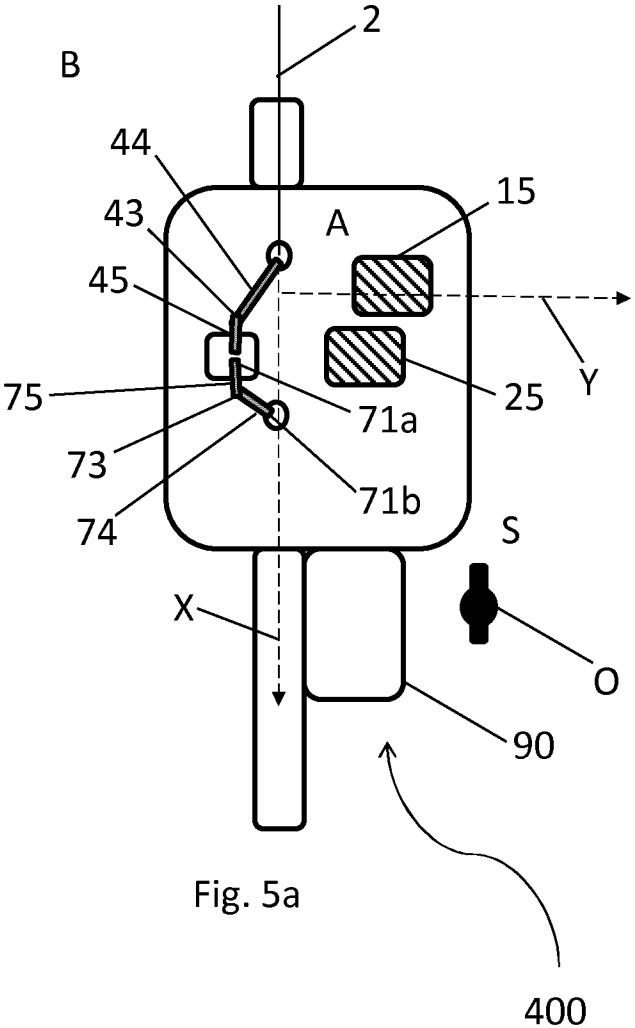

FIGS. 5*a* and 5*b* show a wire cutter apparatus 400 according to a fourth embodiment of the invention.

This wire cutter apparatus 400 works similar as the wire cutter apparatuses in the previous embodiments, however now both rotatable wire guiding tubes comprise a kink and one of them is larger than the other.

This has as advantage that the first crimping press 15 may be placed close to the second crimping press 25 and they can be offset with respect to each other in the lateral direction. By that, it combines the advantages of the wire cutter apparatus according to the second and the third embodiment.

As can be seen FIGS. 5*a* and 5*b* similar reference numbers denote similar features of the previous embodiments. Here, the first rotatable wire guiding tube 40 is similar as that in the third embodiment, namely a first tube 40 comprising a kink 43 and a first tube element 44 and a second tube element 45.

The difference is now that the second rotatable wire guiding tube 70 comprises a kink 73 between a first tube element 74 and a second tube element 75. A total length of the first tube element 74 and the second tube element 75 of the second rotatable wire guiding tube 70 is smaller than the total length of the first tube element 44 and the second tube element 55 of the first rotatable wire guiding tube 40.

The effect can be seen in FIG. 5*b*, where both the first and the second rotatable wire guiding tube 40, 70 are shown in respectively the second wire exit position and the second wire entrance position.

In this position, the wire exit 41*b* of the first rotatable wire guiding tube 40 is adjacent the first crimping press 15 and the wire entrance 71*a* of the second rotatable wire guiding tube 70 is adjacent the second crimping press 25.

This way respectively the leading end 3*a* and the rear end 3*b* of the wire 2 can be crimped.

Figure 7:
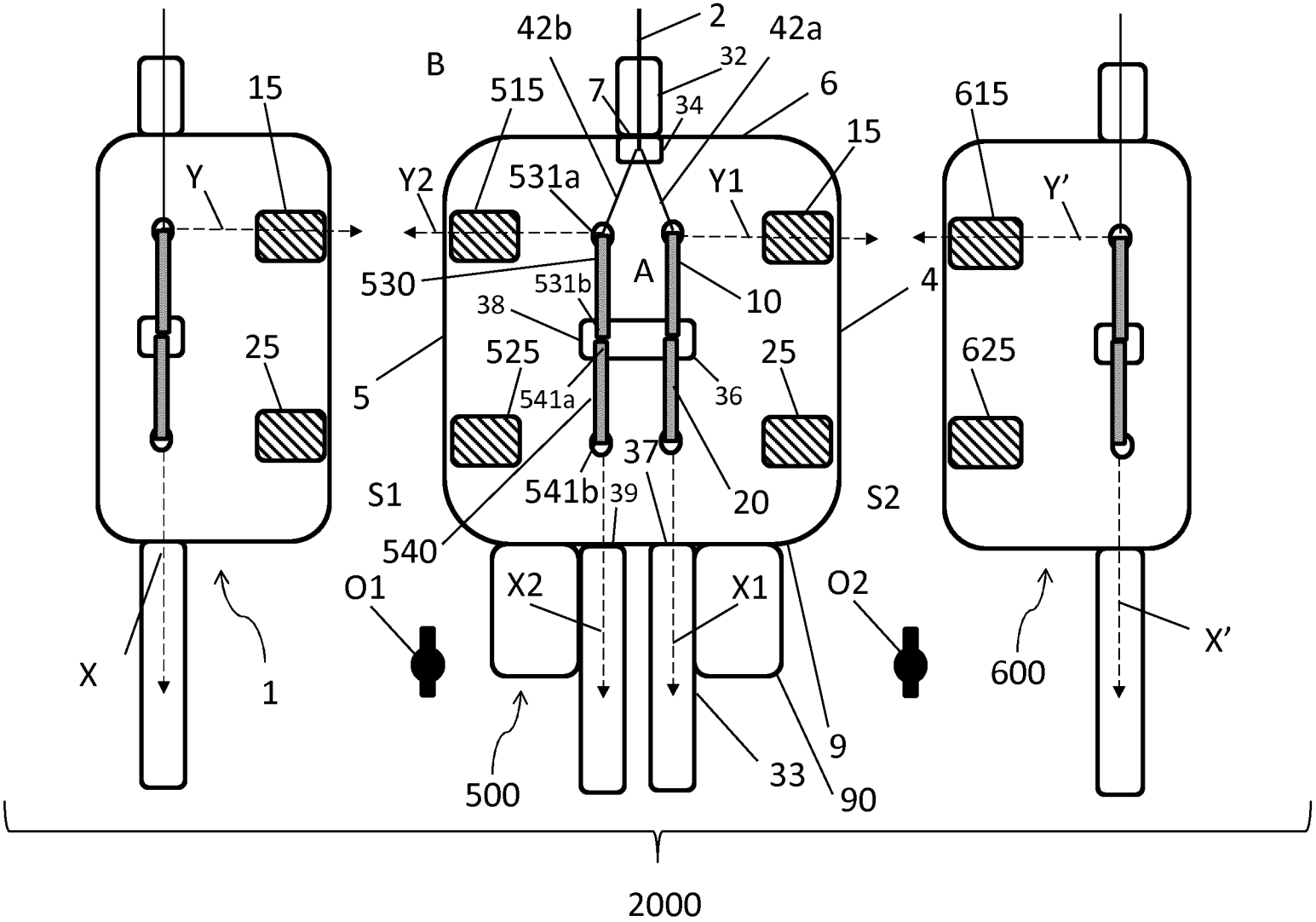
FIG. 7 shows a top view of a wire cutter assembly according to a second embodiment comprising three wire cutter apparatus.

Finally, FIG. 7 shows a fifth embodiment of a wire cutting apparatus 500 according to the invention being the middle wire cutting apparatus 500 in between a wire cutting apparatus 1 a mirrored wire cutting apparatus 600 according to the first embodiment.

The wire cutting apparatus 500 according to the fifth embodiment comprises a third wire crimping press 535 and a fourth wire crimping press 545 as well as a third rotatable wire guiding tube 530 and a fourth rotatable wire guiding tube 540.

A wire divider 34 is provided for continuously dividing a wire 2 into a first wire 42*a* and a second wire 42*b*.

The first wire 42*a* is fed to the first rotatable wire guiding tube 10 and is processes as in one of the previous embodiments.

The second wire 42*b* is fed to the third rotatable wire guiding tube 530. The third rotatable wire guiding tube 530 is suitable for receiving the leading end of the second wire 42*b*. The third tube 530 has a wire entrance 531*a* and a wire exit 531*b* and is rotatable around the wire entrance 531*a* whereby the wire exit 531*b* is movable from a first wire exit position coinciding with the longitudinal feeding axis X2 of the second wire to a second wire exit position spaced away from the longitudinal feeding axis X2 of the second wire and vice-versa.

The third crimping press 535 is suitable for receiving the leading end of the second wire 42*b* when the wire exit of the third rotatable wire guiding tube 530 is in the second wire exit position. The third crimping press 535 is spaced away from the longitudinal feeding axis X2 of the second wire 42*b*.

Note, that as there are two wires 42*a*, 42*b* being cut and crimped simultaneously, there are also two longitudinal feeding axes X1, X2. The first longitudinal feeding axis X1 corresponds to the first wire 42*a*. The second longitudinal feeding axis X2 corresponds to the second wire 42*b*.

The third crimping press 535 is configured to crimp the leading end of the second wire 42*b*.

The wire cutting apparatus 500 according to the fifth embodiment also comprises a fourth rotatable wire guiding tube 540 for receiving the leading wire end of the second wire. The fourth tube 540 has a wire entrance 541*a* and a wire exit 541*b* and is rotatable around its wire exit 541*b* whereby its wire entrance 541*a* is movable from a first wire entrance position coinciding with the longitudinal feeding axis X2 of the second wire 42*b* to a second wire entrance position spaced away from the longitudinal feeding axis X2 of the second wire and vice-versa.

The third rotatable wire guiding tube 530 and the third crimping press 535 are mirrored versions of the first rotatable wire guiding tube 10 and the first crimping press 15. Here, with mirrored is meant mirrored with respect to the longitudinal axis defined by the wire 2 before it is split into a first wire 42*a* and second wire 42*b*.

The fourth rotatable wire guiding tube 540 and a fourth crimping press 545 are similarly mirrored versions of the second rotatable wire guiding tube 20 and the second crimping press 25.

A second wire cutter 38 is configured to cut the second wire 42*b* between the wire exit 531*b* of the third rotatable wire guiding tube 530 and the wire entrance 41*a* of the fourth rotatable wire guiding tube 540 when said wire exit 531*b* and said wire entrance 541*a* are respectively in the first wire exit position and the first wire entrance position.

The fourth crimping press 545 is placed such that it is suitable for receiving a rear wire end from the second wire 42*b* when the wire entrance 541*a* of the fourth tube 540 is in the second wire entrance position. The fourth press 545 is therefore spaced away from the longitudinal feeding axis X2 of the second wire 42*b*. The fourth crimping press 545 is configured to crimp the rear wire end of the second wire.

As the third and the fourth crimping press 535, 545 are mirrored versions of the first and the second crimping press 10, 20, the third crimping press 535 and the fourth crimping press 545 are both at least partially located between the longitudinal feeding axis X2 of the second wire 42*b* and the second side wall 5.

Preferably, the wire cutter apparatus 500 according to the fifth embodiment further comprises a second wire exit opening 39 provided in the fourth side wall for dispensing a cut and crimped second wire to the exterior space B.

Above, five embodiments of wire cutter apparatuses 1, 200, 300, 400, 500 have been described which all have the advantage that its first and second crimping presses are faced towards the same side wall.

This allows a mirroring or multiplication of wire cutter apparatuses forming a wire cutter assembly in which the wire cutter assembly may still be operator by only one operator.

Figure 6B:
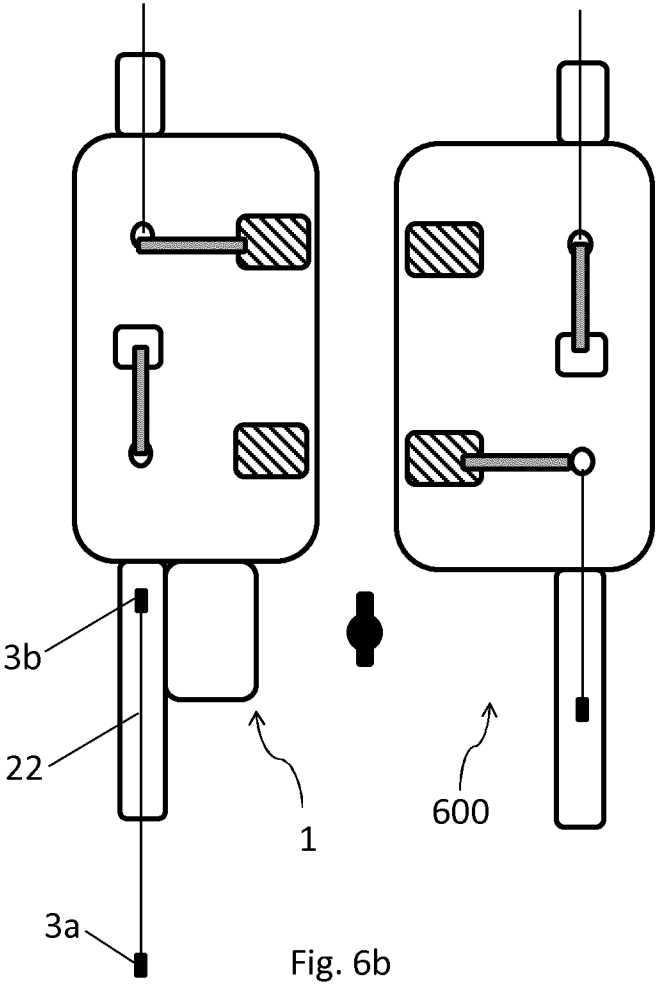
FIGS. 6*a* and 6*b* show a top view of a wire cutter assembly according to a first embodiment comprising two wire cutter apparatus, the assembly being respectively in different positions during the cutting and crimping of a wire.
Figure 6A:
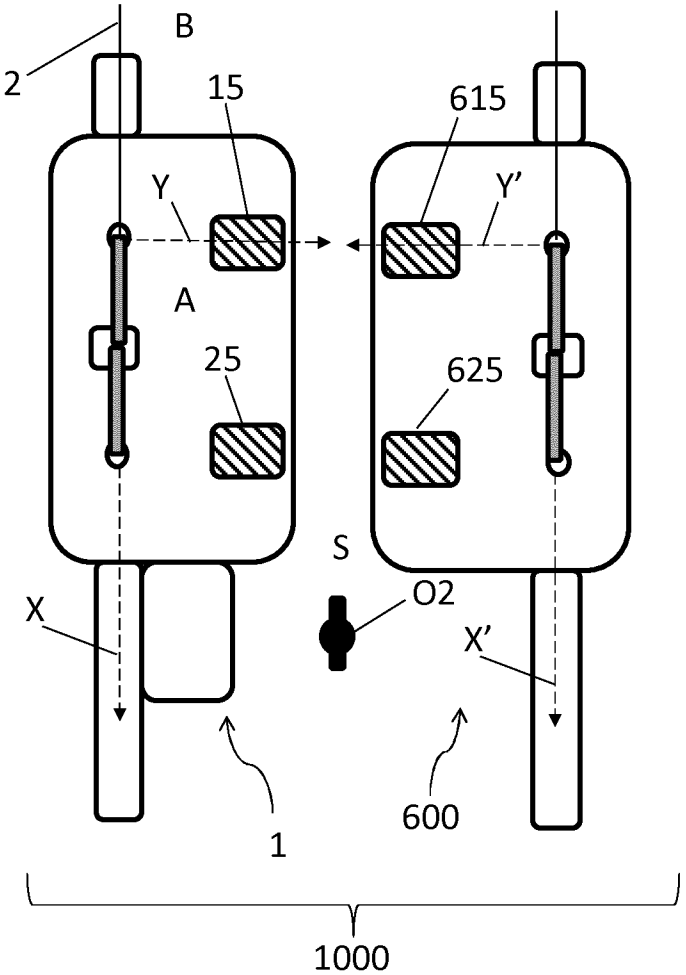

FIGS. 6*a* and 6*b* show a wire cutter assembly 1000 according to a first embodiment.

The wire cutter assembly 1000 comprises a first wire cutter apparatus 1, being similar to the wire cutter apparatus 1 according to the first embodiment.

The wire cutter assembly 1000 further comprises a second wire cutter apparatus 600 according to a sixth embodiment which is a mirror version of the first wire cutter apparatus 1.

On the left side the first wire cutter apparatus 1 is placed and on the right side the second wire cutter apparatus 600 is placed.

Between the first wire cutter apparatus 1 and the second wire cutter apparatus 600 an operator space S is disposed. The operator space S is typically suitable for an operator O to supervise all presses of all wire cutter apparatuses simultaneously.

Therefore, the first and second presses 15, 25 of the first wire cutter apparatus 1 and the first and second presses 615, 625 of the second wire cutter apparatus 600 all face the operator space S.

FIG. 7 shows a wire cutter assembly 1000 according to a second embodiment. Here, the wire cutter assembly 2000 comprises three wire cutter apparatuses 1, 500, 600. A left side a wire cutter apparatus 1 according to the first embodiments is shown. In the middle, a wire cutter apparatus 500 according to the fifth embodiment is shown. At the right side, a wire cutter apparatus 600 according to the sixth embodiment is shown.

In between the first side wall of the wire cutter apparatus 1 according to the first embodiment and the second side wall of the wire cutter apparatus 500 according to the fifth embodiment a first operator space S1 is disposed. In that first operator space S1 a first operator O1 may supervise simultaneous two wire cutting presses of the wire cutter apparatus 1 at the left and two wire cutting presses of the wire cutter apparatus 500 in the middle.

Similarly, a second operator space S2 is disposed for a second operator O2 between the wire cutter apparatus 500 in the middle and the wire cutter apparatus 600 at the right.

This way, using only two operators O1, O2 four cutting and crimping lines involving eight wire cutting presses may be simultaneously supervised.

In the description of the invention, it is foreseen that features from one embodiment may be combined with another embodiment.

Especially, it is foreseen that multiple combinations of different embodiments of wire cutting apparatuses may form a further embodiment of a wire cutting assembly. Although, for example, in FIG. 7 only straight tubes with similar lengths are used, it is foreseen that one or more of the wire cutter apparatuses may have one or more tubes of different lengths and/or comprising a kink.

In a special embodiment of the invention, any wire cutter apparatus according to the invention may comprise a human machine interface 90 that is preferably faced towards the operator space S. In other words, the wire cutter apparatus comprises a human machine interface 90 for controlling the wire cutter apparatus.

In a special preference, a wire cutter assembly, that is comprises of multiple wire cutter apparatuses according to any embodiment, comprises only one human machine interface 90 per operator space.

For example, a human machine interface 90 may comprise one or more of a monitor, a keyboard and/or touchscreen.

In an embodiment of the invention, a wire cutter apparatus according to any of the embodiments comprises a control unit configured to receive inputs from the human machine interface and is configured to generate outputs to the human machine interface. The control unit is further configured to generate control signals in response to the inputs of the human machine interface. The rotatable wire guiding tubes are configured to receive the control signals and rotate in response to the control signals.

In a further embodiment, an assembly of wire cutter apparatuses comprises at least two wire cutter apparatuses each comprising said control unit. A first control unit of a first wire cutter apparatus is configured to receive and transmit operating signals to the second control unit of a second wire cutter apparatus. Vice versa, the second control unit is configured to receive and transmit operating signals to the first control unit. Both control units are configured to generate operating signals representative for the first wire cutter apparatus rotating one of its rotatable wire guiding tubes while the second wire cutter apparatus is crimping using one of its crimping presses and vice versa.

This allows for an optimizing of sequencing and allows for higher production.

In an embodiment of the wire cutter apparatus according to the invention, the wire cutter apparatus is either a left hand drive (LHD) wire cutter apparatus or a right hand drive (RHD) wire cutter apparatus.

The invention claimed is:

1. A wire cutter apparatus for cutting a wire and crimping a leading end and subsequently a rear end of the wire, the wire cutter apparatus comprising;

an interior space defined by side walls, the side walls at least comprising a first side wall and a second sidewall both extending parallel to a longitudinal feeding axis, wherein the second side wall opposes the first side wall;

a third side wall including a wire feeding opening for feeding the wire from an exterior space into the interior space between the first side wall and the second side wall whereby a feeding direction defines the longitudinal feeding axis;

a first rotatable wire guiding tube for receiving the leading end of the wire, said first tube having a first wire entrance and a first wire exit and being rotatable around the first wire entrance whereby the first wire exit is movable between a first wire exit position coinciding with the longitudinal feeding axis and a second wire exit position spaced away from the longitudinal feeding axis;

a first crimping press for receiving the leading wire end of the wire when the first wire exit is in the second wire exit position, the first crimping press being spaced away from the longitudinal feeding axis and configured to crimp the leading end of the wire;

a second rotatable wire guiding tube for receiving the leading end of the wire, said second tube having a wire entrance and a second wire exit and being rotatable around the second wire exit whereby the second wire entrance is movable between a first wire entrance position coinciding with the longitudinal feeding axis and a second wire entrance position spaced away from the longitudinal feeding axis;

a wire cutter configured to cut the wire between the first wire exit and the second wire entrance when said first wire exit and second wire entrance are respectively in the first wire exit position and the first wire entrance position;

a second crimping press for receiving the rear end of the wire when the second wire entrance is in the second wire entrance position, the second crimping press being spaced away from the longitudinal feeding axis and configured to crimp the rear end of the wire;

wherein the first crimping press and the second crimping press are both at least partially located between the longitudinal feeding axis and the first side wall.

2. The wire cutter apparatus according to claim 1, wherein the first rotatable wire guiding tube is configured to move the first wire exit outward from the longitudinal feeding axis toward the first side wall and wherein the second rotatable wire guiding tube is configured to move the second wire entrance outwards from the longitudinal feeding axis toward the first side wall.

3. The wire cutter apparatus according to claim 1, wherein the first rotatable wire guiding tube has a first length, and the second rotatable wire guiding tube has a second length, the first and second lengths are different than one another.

4. The wire cutter apparatus according to claim 3, wherein the first crimping press is spaced away from the longitudinal feeding axis a first distance, and the second crimping press is spaced from the longitudinal feeding axis a second distance, the first and second distances are different than one another.

5. The wire cutter apparatus according to claim 1, wherein at least one of the first and second rotatable wire guiding tubes comprises a kink.

6. The wire cutter apparatus according to claim 1, wherein at least one of the first and second cutting presses is at least partially arranged in the exterior space traversing the first side wall through an opening.

7. The wire cutter apparatus according to claim 1, wherein the first and the second rotatable wire guiding tubes rotate in a horizontal plane and wherein the side walls are in a vertical plane.

8. The wire cutter apparatus according to claim 1, comprising a wire exit opening provided in one of the side walls for dispensing a cut wire to the exterior space.

9. The wire cutter apparatus according to claim 1, wherein the wire cutter apparatus comprises a wire feeder for feeding and transporting the wire into and through the first wire guiding tube.

10. The wire cutter apparatus according to claim 1, wherein the wire cutter apparatus comprises a wire puller for pulling and transporting a cut wire through the second wire guiding tube and into the exterior space.

11. The wire cutter apparatus according to claim 1, comprising;

a wire divider for continuously dividing the wire into a first wire and a second wire, wherein the first wire is fed to the first rotatable wire guiding tube and the second wire;

a third rotatable wire guiding tube for receiving a leading end of the second wire, said third wire guiding tube having a third wire entrance and a third wire exit and being rotatable around the third wire entrance whereby the third wire exit is movable between a first wire exit position coinciding with a longitudinal feeding axis of the second wire and a second wire exit position spaced away from the longitudinal feeding axis of the second wire axis;

a third crimping press for receiving the leading wire end of the second wire when the third wire exit is in the second wire exit position, the third crimping press being spaced away from the longitudinal feeding axis of the second wire and configured to crimp the leading wire end of the second wire;

a fourth rotatable wire guiding tube for receiving the leading wire end of the second wire, said fourth tube having a fourth wire entrance and a fourth wire exit and being rotatable around the fourth wire exit whereby the fourth wire entrance is movable between a first wire entrance position coinciding with the longitudinal feeding axis of the second wire and a second wire entrance position spaced away from the longitudinal feeding axis of the second wire;

a second wire cutter configured to cut the second wire between the third wire exit and the fourth wire entrance when the third wire exit and the fourth wire entrance are respectively in the first wire exit position and the first wire entrance position;

a fourth crimping press for receiving a rear end of the second wire when the fourth wire entrance is in the second wire entrance position, the fourth press being spaced away from the longitudinal feeding axis of the second wire and configured to crimp the rear end of the second wire;

wherein the third crimping press and the fourth crimping press are both at least partially located between the longitudinal feeding axis of the second wire and the second side wall.

12. The wire cutter apparatus according to claim 11, comprising a second wire exit opening provided in one of the side walls for dispensing a cut and crimped second wire to the exterior space.

* * * * *